US005813498A

United States Patent [19]

Hattori et al.

[11] Patent Number: 5,813,498

[45] Date of Patent: Sep. 29, 1998

[54] ELEVATOR DOOR SYSTEM HAVING VARIABLE OPENING/CLOSING WIDTH

[75] Inventors: Kazuhiro Hattori, Yamato; Hideyuki Honma, Kawasaki, both of Japan

[73] Assignee: Otis Elevator Company, Farmington, Conn.

[21] Appl. No.: 645,851

[22] Filed: May 14, 1996

[30] Foreign Application Priority Data

May 22, 1995 [JP] Japan ..... 7-122037

[51] Int. Cl.[6] ..... B66B 13/14

[52] U.S. Cl. ..... 187/324; 187/316

[58] Field of Search ..... 187/324, 334, 187/316; 49/120

[56] References Cited

U.S. PATENT DOCUMENTS 4,491,199 1/1985 Shea ..... 187/29 R

FOREIGN PATENT DOCUMENTS 7125957 5/1995 Japan .

*Primary Examiner*—Kenneth Noland

[57] ABSTRACT

An elevator door system having variable opening/closing width includes a button (1) located in the hall in the loading area for calling the elevator car to that hall, multiple destination floor buttons (2) in the elevator car which indicate the destination floor of the elevator car when pressed, a load sensor (3) which measures the load applied to the elevator car, a door operator (4) which opens the door completely or less than the completely opened width, and a controller (5) which inputs the signals from said hall button (1), destination floor buttons (2), and load sensor (3) and outputs a drive signal to said door operator (4). In the controller, the number of passengers in the elevator car is computed from the load measured by said load sensor (3), and when the result obtained by dividing the number of passengers by the number of destination floor buttons (2) pressed is one or less and a hall call is not generated at the destination floor, a signal which opens the door less than the completely opened width is output from the door operator (4).

1 Claim, 4 Drawing Sheets

CENTER-OPENING DOORS

SIDE-OPENING DOOR

2-SPEED SIDE-OPENING DOOR

ELEVATOR DOOR SYSTEM HAVING VARIABLE OPENING/CLOSING WIDTH

BACKGROUND OF THE INVENTION

1. Technical Field

This invention relates to a door opening/closing variable width system which varies the opening/closing width of an elevator door.

2. Description of the Prior Art

Typically, an elevator passenger gets on the elevator once it has arrived at the waiting floor and then specifies the destination floor by pressing the destination floor button provided in the elevator car. The elevator car is driven to the destination floor, the door (car door(s) and/or hall door) opens, and the passenger gets off when the destination floor is reached.

When the elevator reaches the destination floor, the door opens completely. At this time, if there is only one passenger getting off the elevator, said one passenger gets off the elevator while the door is opening until it is about half way open. Even after the passenger gets off, the door continues to open from the half opened state until it is completely opened. Consequently, the time it takes for the door to go from half way opened to completely opened is wasted time since the passenger has already gotten off. As a result, there was the problem in that extra time was taken and the operating efficiency of the elevator decreased.

DISCLOSURE OF INVENTION

A principal object of the present invention is to provide an elevator door opening/closing variable system in which the door does not continue opening after the one passenger gets off.

In order to achieve the objective, the present invention includes a hall button (i.e. hall call button) at the loading area for calling the elevator car to the hall, multiple destination floor buttons (i.e. car call buttons) in the elevator car which indicate (and initiate registration of) the destination floor of the elevator car when pressed, a load sensor which measures the load applied to the elevator car, a door operator which opens the door completely or opens the door less than the completely opened width, and a controller which inputs the signals from said hall button, destination floor buttons and load sensor and outputs a drive signal to said door operator. The number of passengers in the elevator car is computed from the load measured by said load sensor, and when the result obtained by dividing the number of passengers by the number of destination floor buttons pressed is less than 1 and a hall call is not generated at said destination floor, a signal which opens the door less than the completely opened width is output from said door operator. The invention is readily implemented in software (instructions and data) contained in a memory of the control unit. In addition to the software according to the invention, the control unit includes conventional computer hardware (CPU, I/O, busses, memory, etc.) and conventional software (e.g., operating system, etc.).

In the control panel (controller or control unit), the number of destination buttons pressed is counted and the number of passengers in the elevator is computed. Next, the number of passengers is divided by the number of destination floor buttons pressed, and a numerical value x is computed. If the numerical value x is "1" or less and a hall call has not been generated at each destination floor, only one passenger will be getting off the elevator at the destination floor and no one will be getting on to the elevator. Therefore, a signal is output to the door operator from the control panel and the door is opened slightly less (e.g., half open) than the completely (fully) opened width.

The foregoing and other objects, features and advantages of the present invention will become more apparent in light of the following detailed description and accompanying drawing, in which:

DETAILED DESCRIPTION OF PREFERRED EMBODIMENTS AND BEST MODE

Figure 1:
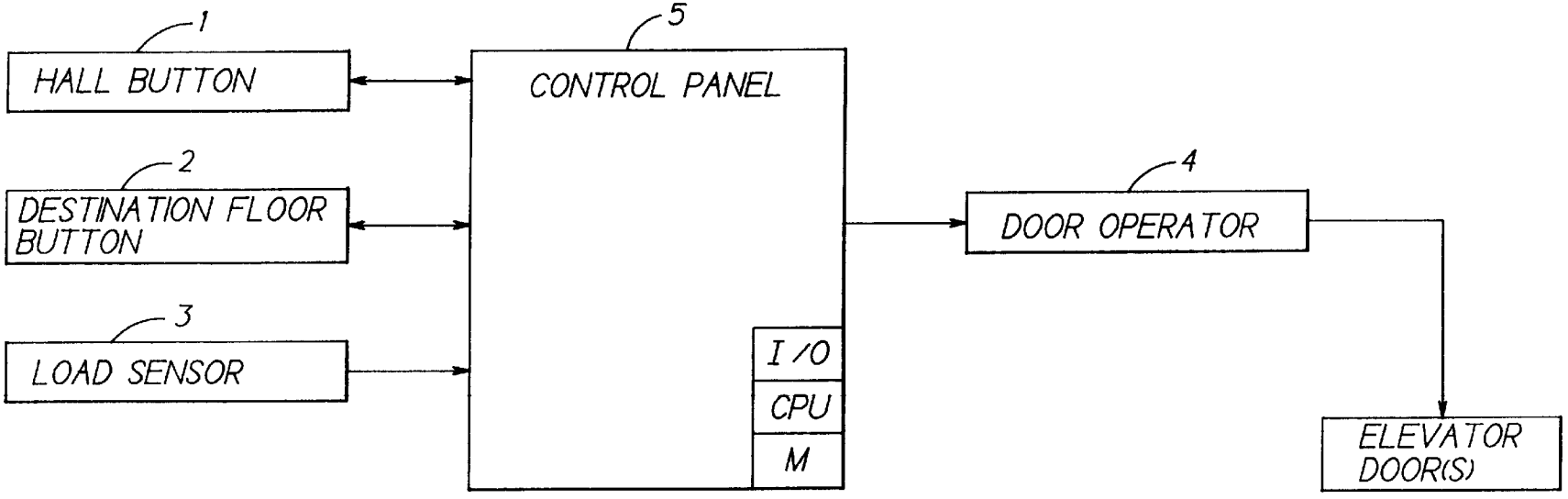
FIG. 1 is a block diagram showing one application example of the elevator door opening/closing variable width system of the present invention.
Figure 2:
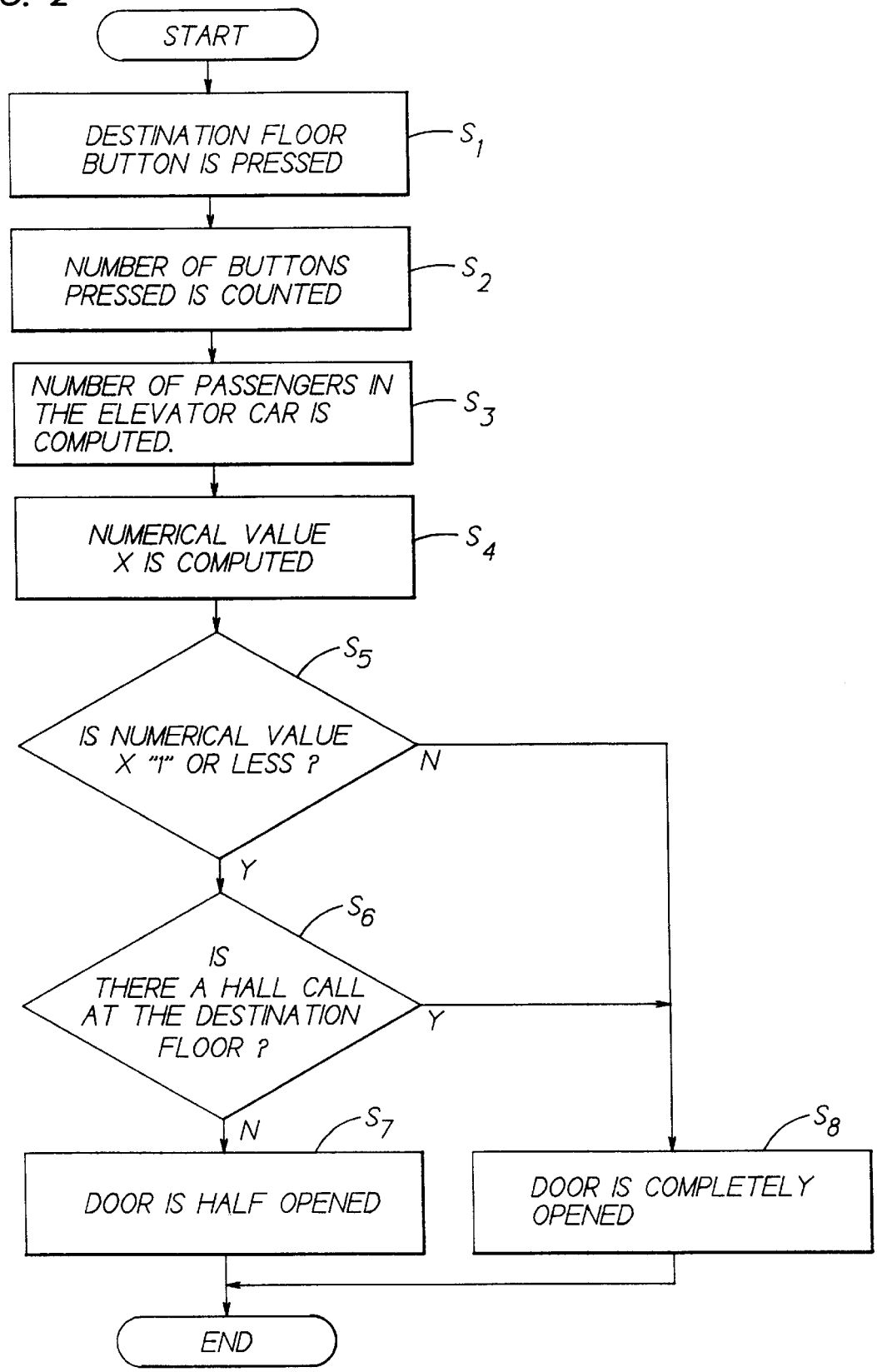
FIG. 2 is a flow chart showing the operation of said door opening/closing variable width system.
Figure 3A:
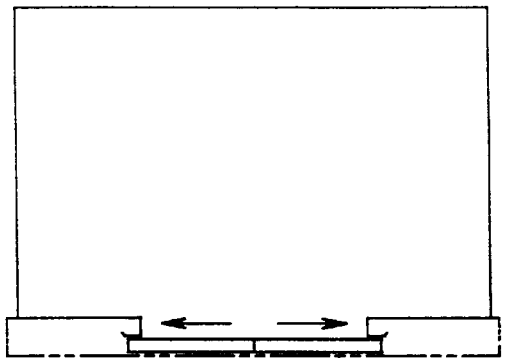
FIG. 3 shows three front schematic diagrams of prior art elevator door arrangements.
Figure 3B:
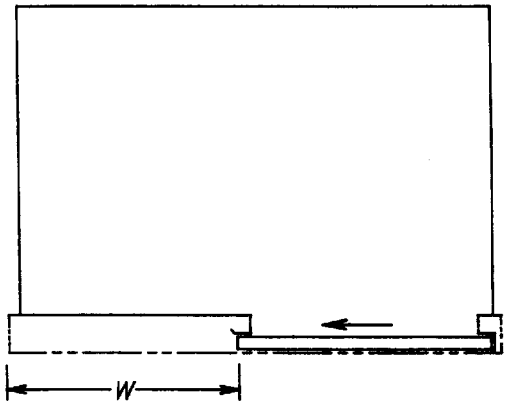
Figure 3C:
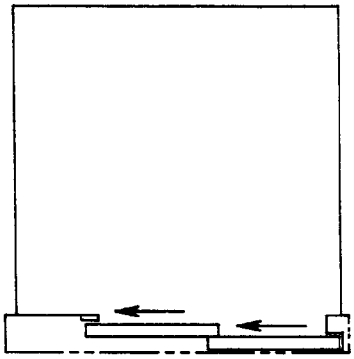
Figure 4:
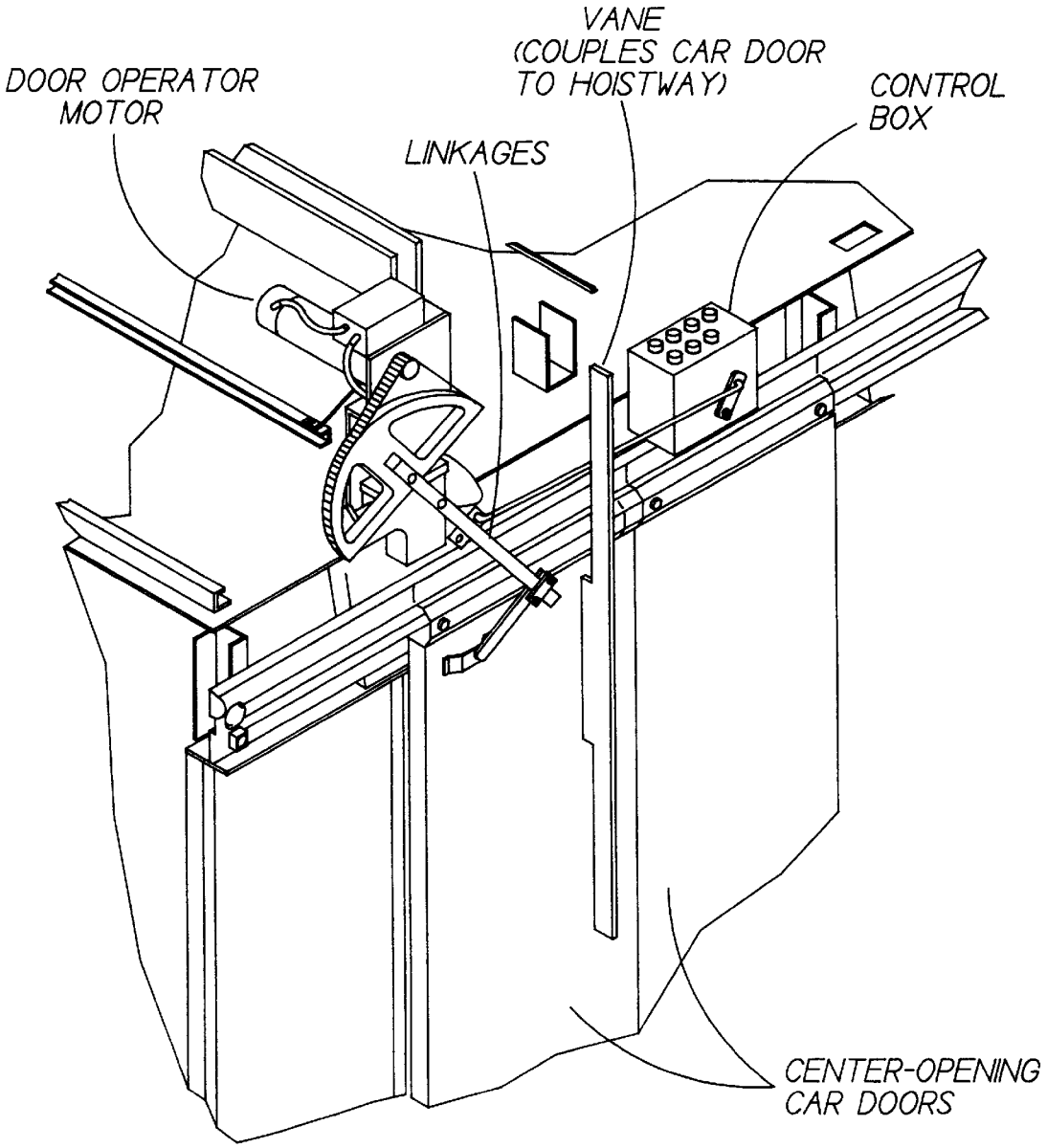
FIG. 4 is a perspective view showing a door operator motor, linkages, etc. according to the prior art.

The present invention will be explained below with reference to the figures. FIGS. 1 and 2 show one application example of the elevator door opening/closing variable width system of the present invention.

In FIG. 1, (1) represents the conventional hall buttons provided in the elevator hall of each floor. These hall buttons (1) include up and down buttons; a hall call is generated for going up when the up button is pressed, and a hall call is generated for going down when the down button is pressed.

Conventional destination floor buttons (2) for indicating the destination floor of the elevator car are provided inside the elevator car (not shown), these destination floor buttons (2) include, for example, pushbuttons with numbers corresponding to each destination floor, and a call is generated when this destination floor button (2) is pressed.

A conventional load sensor (3), which measures the weight of the passengers in the elevator car, is provided in, for example, the floor of the elevator car, and a conventional door operator (4) for opening and closing the door(s) is provided on the ceiling of the elevator car.

Control panel (5) for controlling the operation of the elevator car is provided in the machine room at the top of the elevator shaft (hoistway). When signals from destination floor button (2) and hall button (1) are input and registered in control panel (5), buttons (1) and (2) are lighted. Also, the number of destination floor buttons (2) pressed is counted. For example, if destination floor buttons (2) for the third floor, fifth floor, and sixth floor are pressed, the number of buttons pressed becomes three. If destination floor button (2) for the fifth floor is pressed three times, the number of buttons pressed is only one. Also, a signal for the load of the passengers in the elevator car is output from load sensor (3) and is input to control panel (5) and the number of passengers in the elevator car is computed by dividing said load by an average weight (e.g., 150 lbs.) of a passenger.

Next, the operation of the elevator door opening/closing variable width system will be explained with reference to the flow chart shown in FIG. 2.

When passengers get on the elevator and destination floor buttons (2) are pressed, these pressed signals are output to control panel (5) (Step S1). Next, the number of destination floor buttons (2) pressed is counted in control panel (5) (Step $S_2$). Next, the load of the passengers output from load sensor (3) is divided by the average weight of one passenger to compute the number of passengers (Step $S_3$). Next, the number of passengers is divided by the number of destination floor buttons (2) pressed and a numerical value x is computed (Step $S_4$).

Whether or not the numerical value x is "1" or less is calculated or determined (Step $S_5$). If numerical value x is "1" or less, the passengers on the elevator will get off one-by-one at each destination floor. Next, whether or not the hall button has been pressed at the hall of each destination floor and a hall call has been generated when numerical value x is "1" or less is calculated or determined (Step $S_6$). If a hall call has not been generated at each destination floor, it means that the passenger will get off at the destination floor and no one will get on from the destination floor.

Therefore, a signal is output to door operator (4) from control panel (5) and the door opens slightly less (e.g., half open) than the completely opened width (Step $S_7$).

Because only one passenger is getting off the elevator, even if the door opens only half way, the passenger can get off with plenty of room.

On the other hand, if the numerical value x exceeds "1" or if a hall call has been generated at the destination floor even when numerical value x is "1" or less, it means that the number of passengers getting off the elevator is not less than two or there is a passenger getting on the elevator from the hall, so a signal is output to door elevator (4) and the door opens completely (Step $S_8$).

Even if only one passenger is getting off the elevator, if time is wasted in getting off (e.g., passenger has baggage), it is possible to open the door completely by pressing the door open button provided on the elevator car control panel.

As explained above, according to the present invention, the number of passengers in the elevator is computed from the load measured with a load sensor and a signal is output to the door operator to make the door open less than the completely opened width if the result of having divided said number of passengers by the number of destination floor buttons pressed is one or less and a hall call has not been generated at the hall of the destination floor, so the door does not continue opening after the one passenger gets off the elevator. As a result, consuming excess time is eliminated and the operating efficiency of the elevator is improved.

While it has been shown and described what is presently considered preferred embodiments of the present invention, it will be readily understood to those skilled in the art that various changes and modifications may be made therein without departing from the spirit and scope of the present invention which shall be defined only by claims.

What is claimed is:

1. An elevator door system with variable opening/closing width, characterized in that the system comprises a hall button at a loading area of a hall for causing generation of a hall call for calling an elevator car to the hall, multiple destination floor buttons in the elevator car which indicate a destination floor of the elevator car when pressed, a load sensor for measuring a load applied to the elevator car, a door operator for opening the door completely or opening the door less than a completely opened width, and a controller including a memory which contains software instructions for receiving input signals from said hall button, destination floor buttons, and load sensor, for outputting a drive signal to said door operator, for computing a number of passengers in the elevator car from a load measured by said load sensor, for calculating a result obtained by dividing the number of passengers by the number of destination floor buttons pressed, and for causing an output signal to be output from said door operator if the result of said calculating step is one or less and a hall call is not generated at said destination floor, the output signal being a signal which controls opening the door less than the completely opened width.

* * * * *